US005702590A

United States Patent [19]

Bonte et al.

[11] Patent Number: 5,702,590

[45] Date of Patent: Dec. 30, 1997

[54] PROCESS FOR THE REMOVAL OF MERCURY

[75] Inventors: Geert I. V. Bonte, Diepenbeek, Belgium; Johannes C. J. De Kock, Landgraaf, Netherlands

[73] Assignee: DSM N.V., Heerlen, Netherlands

[21] Appl. No.: 552,978

[22] Filed: Nov. 3, 1995

Related U.S. Application Data

[63] Continuation of PCT/NL94/00094, Apr. 29, 1994.

[30] Foreign Application Priority Data

May 5, 1993 [BE] Belgium ..... 9300453

[51] Int. Cl.[6] ..... C10G 31/00; C10G 31/09; C10G 25/00

[52] U.S. Cl. ..... 208/251 R; 208/253; 208/88; 208/91; 585/800; 585/820

[58] Field of Search ..... 208/251 R, 253, 208/88, 91; 585/800, 820

[56] References Cited

U.S. PATENT DOCUMENTS

| | | | |
|---|---|---|---|
| 4,089,779 | 5/1978 | Neal | 210/695 |
| 4,094,777 | 6/1978 | Sugier et al. | 210/32 |
| 4,110,208 | 8/1978 | Neal | 210/659 |
| 4,298,456 | 11/1981 | Coombs et al. | 208/86 |
| 4,843,102 | 6/1989 | Horton | 521/28 |
| 4,909,926 | 3/1990 | Yan | 208/251 R |
| 4,911,825 | 3/1990 | Roussel et al. | 208/251 R |
| 4,950,408 | 8/1990 | Duisters et al. | 210/660 |
| 4,962,276 | 10/1990 | Yan | 208/251 R |
| 4,986,898 | 1/1991 | Torihata et al. | 208/251 R |
| 5,107,060 | 4/1992 | Yan | 208/251 R |
| 5,133,851 | 7/1992 | Bitter et al. | 208/251 R |
| 5,169,517 | 12/1992 | Buisson et al. | 208/251 R |
| 5,202,301 | 4/1993 | McNamara | 208/251 R |

FOREIGN PATENT DOCUMENTS

| | | | |
|---|---|---|---|
| 319 615 | 6/1989 | European Pat. Off. . | |
| 0 332 526 A1 | 9/1989 | European Pat. Off. . | |
| 0411973 | 2/1991 | European Pat. Off. | 208/251 R |
| 53-67703 | 6/1978 | Japan | 208/251 R |
| 62-277492 | 12/1987 | Japan | 208/251 R |
| 4-348188 | 12/1992 | Japan | 208/251 R |

OTHER PUBLICATIONS

Oder, R.R. et al. "Waste Water Processing with HGMS", Filtration and Separation, pp. 363, 364, 366, 368,369, Jul. 1976.

*Primary Examiner*—Walter D. Griffin
*Attorney, Agent, or Firm*—Cushman Darby & Cushman IP Group of Pillsbury Madison & Sutro, LLP

[57] ABSTRACT

The invention relates to a process for the removal of mercury and/or other heavy metals from a cracker feed with the aid of an adsorbent. The process is characterized in that the feed is also subjected to magnetic filtration.

12 Claims, No Drawings

PROCESS FOR THE REMOVAL OF MERCURY

RELATED APPLICATIONS

This is a continuation of International Appln. No. PCT/NL 94/00094 filed Apr. 29, 1994.

BACKGROUND OF THE INVENTION

1. Field of the Invention

The invention relates to a process for the removal of mercury and/or other heavy metals from a cracker feed with the aid of an adsorbent.

2. Description of the Prior Art

U.S. Pat. No. 4,950,408 describes how mercury is removed from a non-polar organic medium and particularly from a cracker feed such as gas condensate with the aid of a sulphur-containing adsorbent. This is done in order to alleviate or, preferably, avoid problems from mercury during the cracking process and the upgrading of the cracking products. Mercury is known to initiate corrosion of metals (such as aluminium-containing equipment present in those sections where the cracked products are further upgraded) and to poison catalysts further down the process. In addition, mercury is extremely toxic, which is why direct contact with people and/or the environment should be avoided as much as possible.

Besides mercury, such cracker feeds also contain other heavy metals. It is known from for instance U.S. Pat. No. 4,911,825 that such feeds may contain a large number of heavy metals as impurities, the metals generally being present in the form of organo-metallic complexes. As heavy metals may be mentioned here: nickel, vanadium, arsenic, chromium, lead, cobalt, copper and zinc.

The literature already describes many efforts to remove one or more of these metals, which often occur in low concentrations in a cracker feed (concentrations of the order of, say, 10–10,000 ppb (parts per billion)), from such a feed; see for instance both of the above-mentioned patent specifications and the literature references contained in them.

The applicant has found that a process for the removal of mercury and/or other heavy metals from a cracker feed with the aid of an adsorbent does not in all cases yield a satisfactory result and that the treated feed still has too high a content of mercury and/or other heavy metals.

SUMMARY AND OBJECTS OF THE INVENTION

The process according to the present invention offers a solution to the foregoing problem. The present invention involves also subjecting the cracker feed to magnetic filtration.

Without wishing to commit ourselves to any one particular scientific theory, we presume that the result of its invention is due to the capturing of magnetic and/or magnetizable solid impurities in the cracker feed. In the cases that have been encountered the mercury or other heavy metals to be removed seem to adhere at least partially to such solid impurities and therefore can no longer be effectively removed by the adsorbent.

The application of magnetic filtration leads to the removal of such magnetic and/or magnetizable impurities and thus leads to a higher capture efficiency.

As an additional result the process according to the invention leads to a reduced pollution of the equipment in the cracking process through a reduced formation of carbonaceous deposits.

It is known to remove magnetizable impurities from aqueous streams through magnetic filtration. Reference may in this context be made to the article "Waste waterprocessing with HGMS (High Gradient Magnetic Separators)" by R. R. Oder and B. I. Horst, in the Filtration and Separation journal, July/August 1976, pp. 363–377.

The relevant literature gives no indication whatsoever, however, of the fact that a low capture efficiency for mercury and/or other heavy metals from a cracker feed using an adsorbent is attributable to the presence of magnetic and/or magnetizable solid impurities in such a feed.

DETAILED DESCRIPTION OF THE INVENTION

The process according to our invention a cracker feed containing mercury, and perhaps other heavy metals, is subjected to magnetic filtration and subjected to an adsorption treatment.

The process is preferably applied in such a way that the feed is first subjected to magnetic filtration prior to an adsorptive treatment being applied.

A possible embodiment of the magnetic filtration comprises a column filled with a magnetizable or, preferably, a ferromagnetic packing (such as steel wool, sponge iron etc.), the column being provided on the outside with magnets, preferably electromagnets. As mentioned in the above article, extremely high magnetic field gradients (10–100 million Gauss/cm) can be applied in such an embodiment, at magnetic field strengths of 0.01–10 Tesla.

In order to improve the capture efficiency for small, dispersed, solid impurities (the particle size of such solid impurities is of the order of 0.1 to 100 μm (or even larger)) it is preferred to apply, besides magnetic filtration, also microfiltration. The latter, being a technique known to one skilled in the art, is usually carried out as membrane filtration. Its main object is to remove small particles which because of their small size (from 0.1–10 μm) are only partially captured by magnetic filtration. Thus, it is preferred for microfiltration to take place after magnetic filtration. A high removal efficiency would be possible with microfiltration alone; it also has disadvantages:

a relatively large concentrate stream remains;

high pressure drops must be applied across the membrane;

large filter areas are required.

Another possibility of removing solid impurities, i.e. a sedimentation process, has analogous disadvantages. Such a process employs decanter centrifuges, which may also be operated continuously (in that case the sediment is scraped from the drum by means of an Archimedean screw). These machines, however, have a high energy consumption and are expensive to maintain. The above-mentioned disadvantages are largely overcome by applying microfiltration following magnetic filtration.

The magnetic filter is preferably regenerated periodically (that is, rid of the solid material captured on the filter) by disconnecting the magnetic field and flushing with a gas or a liquid. By causing the magnetic field to disappear, which may be accomplished by either removing the magnets or, preferably, by switching off the electromagnets applied, the captured solid material can readily be removed from the magnetic filter and collected for further, separate processing.

The process may be applied to any kind of cracker feed containing the troublesome heavy metals mentioned. The following examples thereof may be mentioned: gas condensate, naphtha, LNG (Liquid Natural Gas).

Depending on the kind of feed (where volatility and viscosity play a role), the temperature at which the process is carried out may vary between −50° and +150° C., more preferably between minus 30 (−30° C.) and +120° C., still more preferably between 0°–60° C.

The process is in principle suitable for any process in which mercury and/or other heavy metals are removed from a cracker feed. It is especially suited for processes where an adsorbent containing sulphur in the form of a mercapto group or a polysulphide group or in the form of metal sulphide is used.

An adsorption process employing a mercapto group is extensively described in U.S. Pat. No. 4,950,408; an adsorbent with a polysulphide group may for instance be obtained by treating a strongly basic ion exchanger with a mixture of alkali metal (hydro)sulphide and elemental sulphur (see e.g. U.S. Pat. No. 4,843,102). As regards the use of a metal suphide as adsorbent, reference may be made to e.g. U.S. Pat. No. 4,094,777, where a copper sulphide on a carrier is used. Other sulphur-containing adsorbents are mentioned in i.a. NL-A-7,613,998 and U.S. Pat. No. 4,911,825. Such agents usually have a carrier material, which may be of either a polymeric nature (e.g. polystyrene crosslinked with divinyl benzene) or of an inorganic nature (such as aluminas, silicas, zeolites, activated carbon). In the case of cracker feeds which because of their high viscosity (at room temperature) are preferably treated at elevated temperature it may be advantageous to apply an inorganic carrier material, which as a rule is less temperature sensitive than polymeric carriers.

If the cracker feed contains non-magnetizable solids, an increased removal efficiency for mercury and/or other heavy metals may be obtained by adding to the cracker feed a magnetizable or magnetic component in combination with a chemical coagulator (such as $FeCl_3$).

By so doing, the impurity can be captured through magnetic filtration after all. As magnetizable or magnetic component use may be made of e.g.: cobalt ferrite, barium ferrite, magnetite, nickel ferrite, ferrite magnets. Preferably, magnetite is used as magnetizable or magnetic component. For further details, reference is made to the above-mentioned article in Filtration and Separation.

The process is elucidated below on the basis of examples and a comparative experiment; it is emphasized that these serve to illustrate the invention and that they must not be regarded as limiting in any way.

EXAMPLE 1

The experimental set-up consisted of the following elements:

a) a magnetic filter consisting of a column 30 cm long and 1 cm in diameter, filled with steel wool (diameter 20–40 μm) with a packing degree of approx. 10%. An external magnetic field of 0.2 Tesla was applied;

b) an adsorption column 16 cm long and 2 cm in diameter, filled with IMAC SM 1$^R$, an adsorbent containing a mercapto group, supplied by Rohm & Haas.

A gas condensate containing on average approx. 350 ppb mercury and approx. 10,000 ppb iron was passed through the set-up at room temperature at a flow rate of 0.2 l/h. Throughout the experiment (50 days) the average mercury outlet concentration was always less than or equal to 10 ppb.

COMPARATIVE EXPERIMENT A

The same feed was passed only through the adsorption column under the same conditions as in Example 1. The capture efficiency for mercury was approx. 65%.

EXAMPLE 2

To the set-up was added a microfilter consisting of a membrane cell with a mesh width of 0.5 μm and a filter area of 28 $cm^2$, which was inserted between the magnetic filtration and the adsorption column. Example 1 was repeated; the average mercury outlet concentration over a period of 75 days was less than or equal to 5 ppb.

What we claim is:

1. A process for the removal of mercury from a mercury-containing cracker feed, which comprises the combination of steps of:

subjecting said cracker feed to magnetic filtration; and removing mercury from said cracker feed by contacting said cracker feed with an adsorbent.

2. A process according to claim 1, wherein said process further comprises, after said subjecting step, further subjecting the cracker feed to microfiltration.

3. A process according to either of claims 1–2, wherein in said magnetic filtration is conducted using a magnetic filter comprising a column filled with ferro-magnetic material.

4. A process according to claim 3, wherein said process further comprises the step of periodically regenerating said magnetic filter by disconnecting the magnetic field and flushing said magnetic filter with a gas or liquid.

5. A process according to claim 1 or 2, wherein said process is conducted at a temperature of −30° C. to 120° C.

6. A process according to claim 1 or 2, wherein said adsorbent contains sulphur in the form of a mercapto group, a polysulphide group or a metal sulphide.

7. A process according to claim 1 or 2, wherein said process further comprises the step of adding a magnetic or magnetizable component to the cracker feed in combination with a chemical coagulator, and then subjecting said cracker feed to said magnetic filtration.

8. A process according to claim 7, wherein said magnetic or magnetizable component comprises magnetite.

9. A process according to claim 1 or 2, wherein said cracker feed comprises gas condensate, naphtha, or liquid natural gas.

10. A process according to claim 3, wherein said process is conducted at a temperature between 0° C. and 60° C.

11. A process according to claim 1 or 2, wherein said magnetic filtration is conducted at a magnetic field strengths of 0.01 to 10 Tesla.

12. A process according to claim 1, wherein said process further comprises removing particles in the range of 0.1 to 10 um from the cracker feed following said magnetic filtration.

* * * * *